US010532263B2

(12) United States Patent
Beloin et al.

(10) Patent No.: US 10,532,263 B2
(45) Date of Patent: Jan. 14, 2020

(54) GOLF PUTTING TRAINING DEVICE

(71) Applicants: Gregory M. Beloin, Farmington, CT (US); William L. Rubinow, Farmington, CT (US)

(72) Inventors: Gregory M. Beloin, Farmington, CT (US); William L. Rubinow, Farmington, CT (US)

( * ) Notice: Subject to any disclaimer, the term of this patent is extended or adjusted under 35 U.S.C. 154(b) by 0 days.

(21) Appl. No.: 15/829,398

(22) Filed: Dec. 1, 2017

(65) Prior Publication Data

US 2018/0154238 A1 Jun. 7, 2018

Related U.S. Application Data

(60) Provisional application No. 62/429,404, filed on Dec. 2, 2016.

(51) Int. Cl.
*A63B 69/36* (2006.01)
*A63B 71/06* (2006.01)

(52) U.S. Cl.
CPC .. *A63B 69/3676* (2013.01); *A63B 2071/0694* (2013.01)

(58) Field of Classification Search
CPC ..... A63B 69/3676
See application file for complete search history.

(56) References Cited

U.S. PATENT DOCUMENTS 3,073,602 A * 1/1963 Bell ..... A63B 69/3676 473/229
4,828,267 A * 5/1989 Goodrich ..... A63B 67/02 473/160
5,501,452 A * 3/1996 Halvorson ..... A63B 69/3676 473/260
6,179,722 B1 * 1/2001 Bond ..... A63B 69/3676 473/180
6,840,870 B1 * 1/2005 Froggatte ..... A63B 24/0003 473/261

* cited by examiner

*Primary Examiner* — Jeffrey S Vanderveen
(74) *Attorney, Agent, or Firm* — O'Shea Getz P.C.

(57) ABSTRACT

A golf putting training device is provided. The training device includes a body having a forward end, an aft end, an upper surface extending between the forward end and the aft end, at least one base surface that defines a contact plane, and a slot open through a portion of the upper surface and the forward end, and which slot has a width greater than the diameter of a golf ball. The upper surface is disposed at an angle relative to the contact plane in the range of about 1.5 to about 4.0 degrees, with a distance between at least a portion of the upper surface and the contact plane increasing in a direction from the aft end toward the forward end.

13 Claims, 3 Drawing Sheets

GOLF PUTTING TRAINING DEVICE

This application claims the benefit of U.S. Provisional Patent application Ser. No. 62/429,404 filed Dec. 2, 2016, which application is hereby incorporated by reference in its entirety.

BACKGROUND OF THE INVENTION

1. Field of the Invention

The present disclosure relates to golf putting training devices and more particularly to golf putting training devices that assist the user in striking the golf ball for enhanced accuracy.

2. Background Information

In a golf putting stroke, there is an address position, a back stroke, and a through stroke. The address position is when the putter is at rest. The back stroke is the portion of the golf stroke when a golfer moves the putter away from the address point and away from the golf ball. The through stroke is the portion of the swing from the furthest point of the back stroke, forward towards the golf ball, through and forward of the address point. The manner in which the golf ball is struck is critical to the accuracy of the putt.

SUMMARY OF THE INVENTION

According to the disclosure, a golf putting training device is provided. The training device includes a body having a forward end, an aft end, an upper surface extending between the forward end and the aft end, at least one base surface that defines a contact plane, and a slot open through a portion of the upper surface and the forward end, and Which slot has a width greater than the diameter of a golf ball. The upper surface is disposed at an angle relative to the contact plane in the range of about 1.5 to about 4.0 degrees, with a distance between at least a portion of the upper surface and the contact plane increasing in a direction from the aft end toward the forward end.

The features and advantages of the present invention will become apparent in light of the detailed description provided below, as illustrated in the accompanying drawings.

DETAILED DESCRIPTION

In order to produce a proper putting stroke, the mechanics of the golfer's putting stroke are critical. Furthermore, the mechanics of the putting stroke must be repeatable. The present golf putting training device is designed to train a user to strike a golf ball in a desirable and repeatable manner. The term "topspin" as used herein refers to the golf ball rotating forward (i.e., towards the cup) as it is moving. A golf ball putted with no topspin will skid for some distance on the putting surface, which skidding motion can introduce unpredictability into distance and direction of the putt. An application of topspin to the golf ball enhances distance control and maintenance of the putting line. The term "putting line" refers to the intended path of the golf ball after the golf ball has been struck by the putter.

Figure 1:
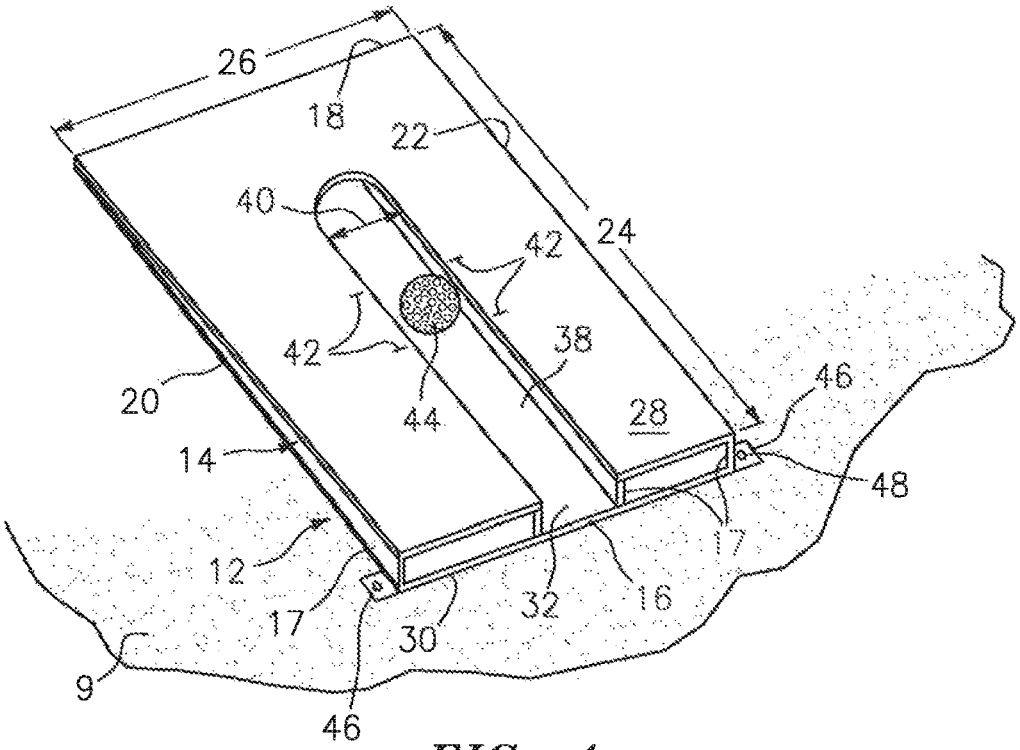
FIG. 1 is a diagrammatic perspective view of an embodiment of the present training device.
Figure 1A:
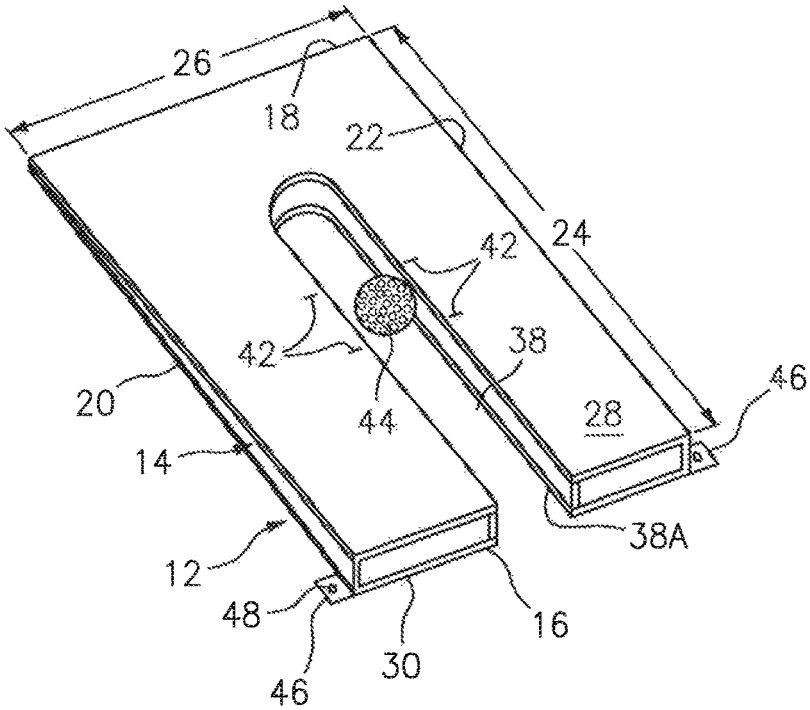
FIG. 1A is a diagrammatic perspective view of an embodiment of the present training device.
Figure 2:
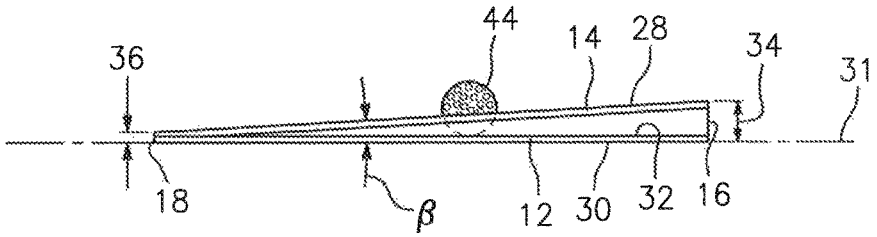
FIG. 2 is a diagrammatic side view of the training device embodiment shown in FIG. 1.

Now referring FIGS. 1 and 2, an embodiment of the present training device is shown residing on a putting surface 9. The training device 10 has a base panel 12, a top panel 14, a forward end 16, an aft end 18, a first lateral side 20, and a second lateral side 22. In the embodiments shown in FIGS. 1 and 2, the base panel 12 and the top panel 14 extend between the forward end 16 and the aft end 18, but not necessarily the entirety of the length between the aft end 18 and the forward end 16. The length 24 of the device 10 extends between the forward and aft ends 16, 18. The width 26 of the device 10 extends between the lateral sides 20, 22. The top panel 14 includes an upper surface 28. The base panel 12 includes an outer surface 30 and an inner surface 32. The base panel outer surface 30 defines a contact plane 31 of the device 10; e.g., when the training device 10 is positioned on a putting surface, the contact plane 31 is substantially contiguous with the putting surface 9. At least a portion of the top panel upper surface 28 is skewed at an angle "β" from the base panel outer surface 30/contact plane 31. For example, in the embodiment shown in FIGS. 1 and 2, the entirety of the top panel upper surface 28 is skewed at an angle "β" from the base panel outer surface 30. In the embodiment shown in FIGS. 3 and 4, less than the entirety of the top panel upper surface 128 is skewed at an angle "β" from the base panel outer surface 130. The top panel 14 may be connected to and supported by the base panel 12 by one or more spacers 17. The present disclosure is not limited to any particular number of spacers 17 or spacer arrangement. The angle β is typically in the range of about one and one-half degrees to about four degrees (1.5-4.0 degrees), and preferably about 2.8 degrees. The top panel upper surface 28 is separated from the base panel outer surface 30 at the forward end 16 by a first distance 34, and the top panel outer surface 28 is separated from the base panel outer surface 30 at the aft end 18 by a second distance 36. The first distance 34 is greater than the second distance 36. A slot 38 is disposed in the top panel 14. The slot 38 is open at the forward end 16, and extends a distance towards the aft end 18. In some embodiments, the slot 38 may extend entirely from the forward end 16 to the aft end 18. The slot 38 has a width 40 that is large enough to receive a golf ball (e.g., at least 1.68 inches). In some embodiments (e.g., see FIG. 1A), the base panel 12 may include a slot 38A similar to that disposed in the top panel 14. In these embodiments, the golf ball 44 rests on the putting surface 9 when the golf ball is "loaded" within the training device 10; i.e., disposed within the slots 38.

Figure 3:
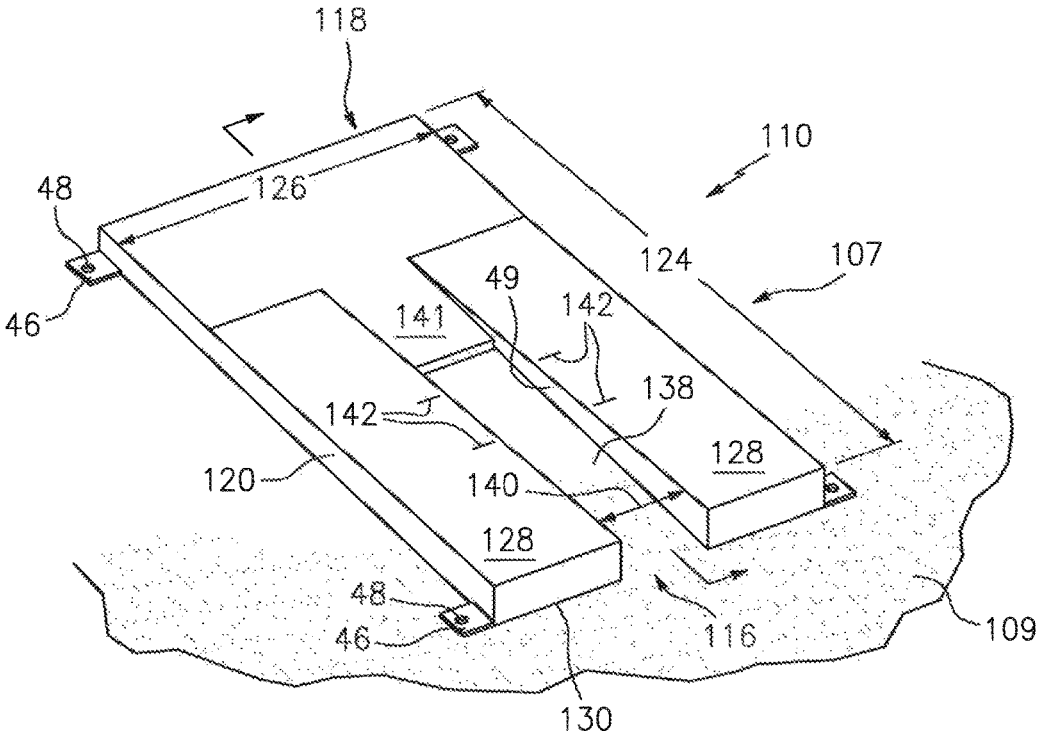
FIG. 3 is a diagrammatic perspective view of an embodiment of the present training device.
Figure 4:
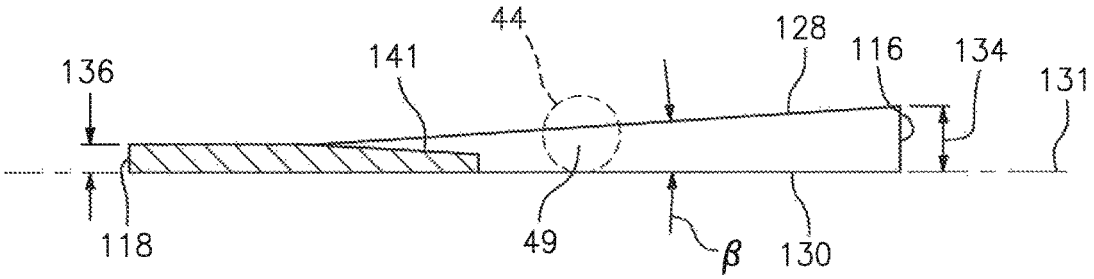
FIG. 4 is a diagrammatic sectioned side view of the training device embodiment shown in FIG. 3, cut along line 4-4.

Now referring to FIGS. 3 and 4, an embodiment of the present training device is shown residing on a putting surface 109. The training device 110 is a ramp-shaped device having a body 107 configured as a unitary structure. The term "unitary structure" as used herein means that the body 107 is a one-piece structure. The unitary structure may be substantially uniform in cross-section, formed as a solid structure, formed of a homogenous material, may include a shell material enclosing a second fill material, etc. The body 107 includes an upper surface 128, a bottom surface 130, a forward end 116, an aft end 118, a first lateral side 120, and a second lateral side 122. The length 124 of the device 110 extends between the forward and aft ends 116, 118. The width 126 of the device 110 extends between the lateral sides 120, 122. The bottom surface 130 defines a contact plane 131 of the device 110; e.g., when the training device 110 is positioned on a putting surface 109, the contact plane 131 is substantially contiguous with the putting surface 109. At least a portion of the upper surface 128 is skewed at an angle "β" from the bottom surface 130. The angle β is typically in the range of about one and one-half degrees to about four degrees (1.5-4.0 degrees), and preferably about 2.8 degrees. The upper surface 128 is separated from the bottom surface 130 at the forward end 116 by a first distance 134, and the upper surface 128 is separated from the bottom surface 130 at or near the aft end 118 by a second distance 136. The first distance 134 is greater than the second distance 136. The training device 110 includes a slot 138 extending from the upper surface 128 toward the bottom surface 130, which slot may extend completely between the upper surface 128 toward the bottom surface 130; e.g., as shown in FIGS. 3 and 4. The slot 138 is open at the forward end 116, and extends a distance towards the aft end 118. The position of the slot 138, disposed between the first and second lateral sides 120, 122, gives the training device 110 a "U-Shaped" configuration. The slot 138 has a width 140 that is large enough to receive a golf ball (e.g., at least 1.68 inches).

Figure 5:
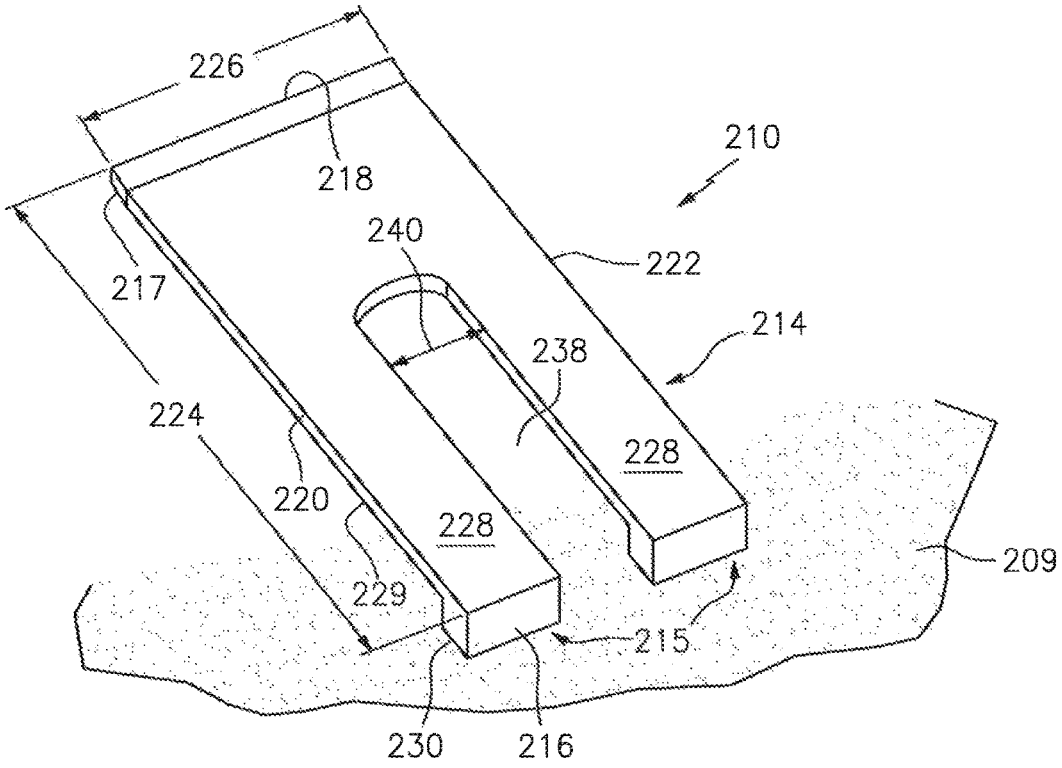
FIG. 5 is a diagrammatic perspective view of an embodiment of the present training device.
Figure 6:
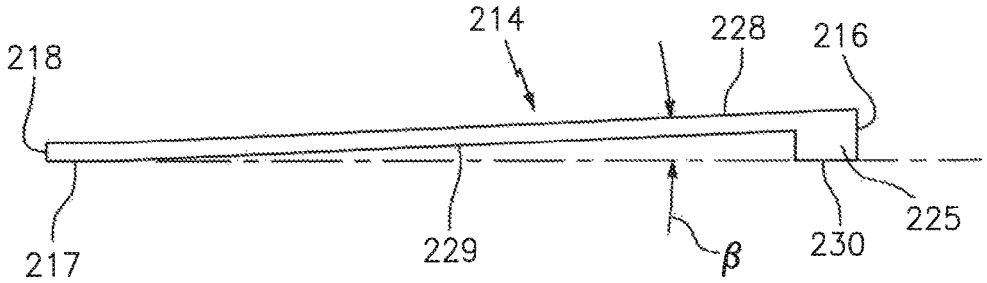
FIG. 6 is a diagrammatic sectioned side view of the training device embodiment shown in FIG. 5.

Now referring to FIGS. 5 and 6, an embodiment of the present training device is shown residing on a putting surface 209. The training device 210 is a ramp-shaped device having a top panel 214, at least one top panel support 215, a forward end 216, an aft end 218, a first lateral side 220, and a second lateral side 222. The top panel 214 extends between the forward end 216 and the aft end 218. The length 224 of the device 210 extends between the forward and aft ends 216, 218. The width 226 of the device 210 extends between the lateral sides 220, 222. The top panel 214 includes an upper surface 228 and a bottom surface 229. The at least one top panel support 215 has a bottom surface 230. A contact plane 231 may be described as extending between: a) a bottom-most surface or edge of the top panel 214 (e.g., an aft edge 217 of the top panel 214, or an element supporting the same); and b) the bottom surface 230 of the at least one top panel support 215. The contact plane 231 is generally contiguous with a putting surface 209 on which the training device 210 would be resting. At least a portion of the top panel upper surface 228 is skewed at an angle "β" from the aforesaid contact plane 231 extending between the aft edge/surface of the top panel 214 and the bottom surface 230 of the at least one top panel support 215. The angle β is typically in the range of about one and one-half degrees to about four degrees (1.5-4.0 degrees), and preferably about 2.8 degrees. A slot 238 is disposed in the top panel 214. The slot 238 is open at the forward end 216, and extends a distance towards the aft end 218. The slot 238 has a width 240 that is large enough to receive a golf ball (e.g., at least 1.68 inches).

In some embodiments, one or more alignment markers (e.g., see FIGS. 1-4; 42, 142) are provided on the outer surface 28, 128, 228 of the top panel 14, 114, 214 adjacent the slot 38, 138, 238. The alignment markers are positioned at a point relative to the slot where the full diameter of a golf ball disposed in the slot and in communication with the contact plane is proximate the upper surface; e.g., slightly below the upper surface.

In some embodiments, the training device 10, 110, 210 may include structure for securing the device to the putting surface. For example, in FIG. 1, the training device 10 includes a plurality of tabs 46 attached to the base panel 12. Each tab 46 includes an aperture 48 for receiving a pin that can be inserted into the putting surface to secure the device 10.

In some embodiments, the training device 10, 110, 210 may include a detest structure (e.g., a dimple disposed in the upper surface 32 of the base panel 12, or one or more small projections 49 extending outwardly from an edge of the slot (e.g., see FIGS. 3 and 4), or a member extending across the slot 38, 138, 238, etc.) that holds the golf ball in place prior to being struck by the user.

In some embodiments, at least a portion of the outer surface 28, 128, 228 may include a light reflective material (or the portion of the outer surface 28, 128, 228 may be configured to be light reflective). For example, a center portion 141 of the outer surface 128 of the embodiment shown in FIGS. 3 and 4 may include a light reflective material (or may be configured to be light reflective). The light reflective surface may give the user "feedback" regarding their positioning.

During use of the device, the golfer places the device 10, 110, 210 on the putting surface. The golfer may then place a golf ball 44 in the slot 38, 138, 238; e.g., proximate the alignment marks 42, 142. The golfer then stands over the device and golf ball 44 and addresses the golf ball. The golfer draws the blade of the putter backward in his backstroke. As the golfer begins his through stroke toward the golf ball 44, the putter blade is guided by the slope of the upper surface 28, 128, 228; i.e., the top panel 14, 114, 214 of the training device causes the putter blade to travel at an upward slope angle approximately equivalent to the slope angle of the upper surface (e.g., "β"). The upward slope angle of the putting stroke causes the putter blade to strike the golf ball 44 at a point at or above the midpoint (i.e., maximum diameter) of the golf ball. Striking the golf ball in this manner gives the golf ball 44 desirable topspin; i.e., the ball will be rotating in a direction toward the target.

While various embodiments of the present invention have been disclosed, it will be apparent to those of ordinary skill in the art that many more embodiments and implementations are possible within the scope of the invention. For example, the present invention as described herein includes several aspects and embodiments that include particular features. Although these features may be described individually, it is within the scope of the present invention that some or all of these features may be combined with any one of the aspects and remain within the scope of the invention. Accordingly, the present invention is not to be restricted except in light of the attached claims and their equivalents.

We claim:

1. A golf putting training device, comprising:

a body having a forward end, an aft end, an upper surface extending between the forward end and the aft end, at least one base surface that defines a contact plane, and a slot that extends lengthwise from an open first end to a distal second end, the open first end disposed at the forward end of the body, wherein the slot is open through a portion of the upper surface, and which slot has a width greater than a diameter of a golf ball, and wherein the body is a unitary structure;

wherein the upper surface is disposed at an angle relative to the contact plane in a range of 1.5 to 4.0 degrees, such that a first distance extending between the upper surface and the contact plane at the distal second end of the slot is less than a second distance extending between the upper surface and the contact plane at the forward end of the slot; and wherein the slot has a depth that is a minimum distance between the upper surface and the contact plane at any lengthwise point of the slot, and the depth for at least a lengthwise portion of the slot is at least 0.8 inches.

2. The training device of claim 1, wherein the slot extends from the upper surface to the base surface, thereby giving the body a U-shaped configuration.

3. The training device of claim 2, further comprising one or more surface retention members.

4. The training device of claim 2, further comprising one or more golf ball detent elements.

5. The training device of claim 2, further comprising one or more alignment markings disposed on the upper surface, which markings are disposed relative to the slot.

6. A golf putting training device, comprising:

a body having a forward end, an aft end, an upper surface extending between the forward end and the aft end, at least one base surface that defines a contact plane, and a slot that extends lengthwise from an open first end to a distal second end, the open first end disposed at the forward end of the body, wherein the slot is open through a portion of the upper surface, and which slot has a width greater than a diameter of a golf ball;

wherein the upper surface is disposed at an angle relative to the contact plane in a range of 1.5 to 4.0 degrees, such that a first distance extending between the upper surface and the contact plane at the distal second end of the slot is less than a second distance extending between the upper surface and the contact plane at the forward end of the slot; and wherein the body includes a base panel, a top panel, and at least one spacer disposed between and in contact with the top panel and the base panel; and wherein the upper surface is a surface of the top panel and the base panel defines the contact plane, and the slot extends through at least a portion of the top panel.

7. The training device of claim 6, wherein the slot extends through at least a portion of the base panel.

8. The training device of claim 6, further comprising one or more surface retention members.

9. The training device of claim 6, further comprising one or more golf ball detent elements.

10. The training device of claim 6, further comprising one or more alignment markings disposed on the upper surface, which markings are disposed relative to the slot.

11. A golf putting training device, comprising:

a body having a forward end, an aft end, an upper surface extending between the forward end and the aft end, at least one base surface that defines a contact plane, and a slot that extends lengthwise from an open first end to a distal second end, the open first end disposed at the forward end of the body, wherein the slot is open through a portion of the upper surface, and which slot has a width greater than a diameter of a golf ball;

wherein the upper surface is disposed at an angle relative to the contact plane in a range of 1.5 to 4.0 degrees, such that a first distance extending between the upper surface and the contact plane at the distal second end of the slot is less than a second distance extending between the upper surface and the contact plane at the forward end of the slot;

wherein the body includes a top panel, and at least one top panel support disposed in contact with the top panel proximate the forward end; and wherein the at least one top panel support includes a bottom surface; and wherein the upper surface is a surface of the top panel, and the top panel support bottom surface and the aft end of the top panel define the contact plane, and the slot extends through at least a portion of the top panel, thereby giving the body a U-shaped configuration.

12. The training device of claim 11, further comprising one or more surface retention members.

13. The training device of claim 11, further comprising one or more alignment markings disposed on the upper surface, which markings are disposed relative to the slot.

* * * * *